US006334271B1

(12) United States Patent
Su Yeh

(10) Patent No.: US 6,334,271 B1
(45) Date of Patent: Jan. 1, 2002

(54) CUP

(75) Inventor: Mel-Fen Su Yeh, Tainan Hsien (TW)

(73) Assignee: Wea Bor Co., Ltd., Tainan (TW)

( * ) Notice: Subject to any disclaimer, the term of this patent is extended or adjusted under 35 U.S.C. 154(b) by 0 days.

(21) Appl. No.: 09/552,594

(22) Filed: Apr. 19, 2000

(51) Int. Cl.[7] ..... G09F 19/00; B65D 25/00
(52) U.S. Cl. ..... 40/430; 220/62.14; 220/703
(58) Field of Search ..... 40/427, 429, 430, 40/431; 220/62.12, 62.14, 662, 665, 703

(56) References Cited

U.S. PATENT DOCUMENTS 5,732,492 A * 3/1998 Lin ..... 40/410
5,769,680 A * 6/1998 Hoffman ..... 446/75
5,839,599 A * 11/1998 Lin ..... 220/410
5,967,307 A * 10/1999 Wang ..... 206/217
6,163,248 A * 12/2000 Paeck et al. ..... 340/321

* cited by examiner

*Primary Examiner*—Christopher P. Schwartz
(74) *Attorney, Agent, or Firm*—Rosenberg, Klein & Lee

(57) ABSTRACT

A cup includes a cup body and a base. The cup body consists of an outer cup; a revolving member, a decorative ring, and an inner cup having an upper flange adhered with the outer cup. The outer cup and the decorative ring are transparent, and the decorative ring and the inner cup are printed with patterns. The base has a housing containing a drive circuit, a motor and a rotating member and a bottom cap. The housing has an upper center recess for the cup body to rest on and automatically turn on the drive circuit to power the motor to rotate the rotating member through a gear unit. The rotating member has plural magnets to attract magnets of the revolving member. In using, the cup body is placed on the center recess of the base, and then the drive circuit is turned on to let the motor rotate the rotating member and subsequently the revolving member and the decorative ring rotated by mutual attraction of the magnets of the rotating member and of the revolving member to let the patterns of the decorative ring and the inner cup body cross over mutually to produce intriguing effect.

11 Claims, 6 Drawing Sheets

CUP

BACKGROUND OF THE INVENTION

This invention relates to a cup, particularly to one having an inner decorative ring revolved to produce interesting and intriguing effect.

Cups are common utensils in our daily life, widely used, having quite variety of them for consumers to choose. Manufactures have competed in offering improved cups to attract consumers.

SUMMARY OF THE INVENTION

The objective of the invention is to offer an interesting cup, which includes a cup body consisting of an outer cup and an inner cup, a revolving member and a decorative ring between the outer and the inner cup. The revolving member has plural magnets and the decorative ring is fixed at an outer edge of the revolving member. The inner cup and the outer cup are adhered together at upper ends. The outer cup and decorative ring are transparent, and the decorative ring and the inner cup are printed with patterns. Further, a base is provided to include a housing containing a drive circuit, a motor, and a rotating member and a bottom cap closing up the bottom. The housing has an upper surface for the cup body to rest on, and the drive circuit powers the motor to rotate the rotating member via a gear unit. The rotating member has plural magnets to attract the magnets of the revolving member. In using the cup body is placed on the base and then the drive circuit is automatically turned on to rotate the motor and subsequently the rotating member. Then the magnets of the rotating member attract those of the revolving member to force the revolving member and the decorative ring to rotate, letting the patterns of the decorative ring and the of the inner cup cross over to produce intriguing effect.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
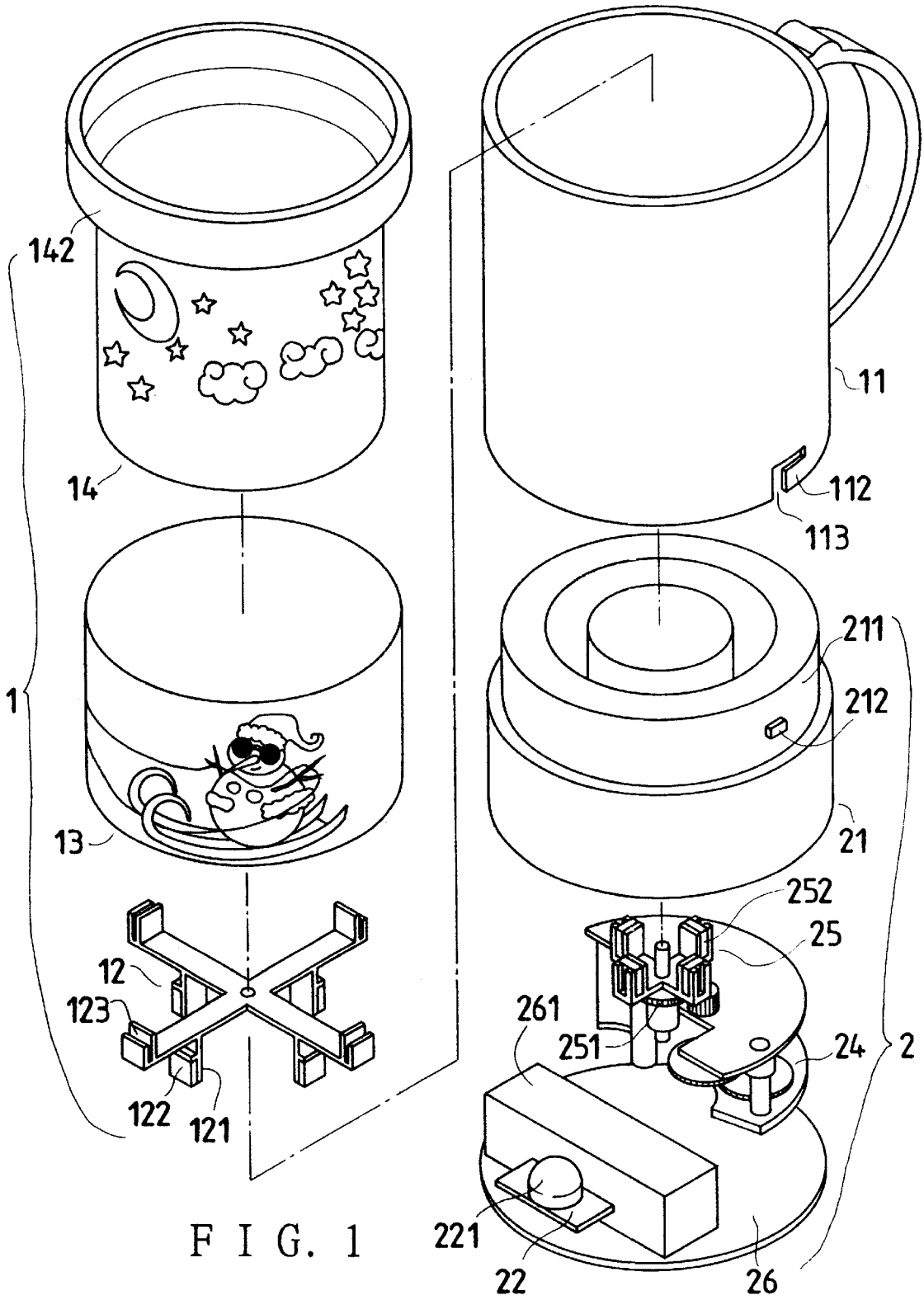
FIG. 1 is an exploded perspective view of a first embodiment of a cup of the present invention.
Figure 2:
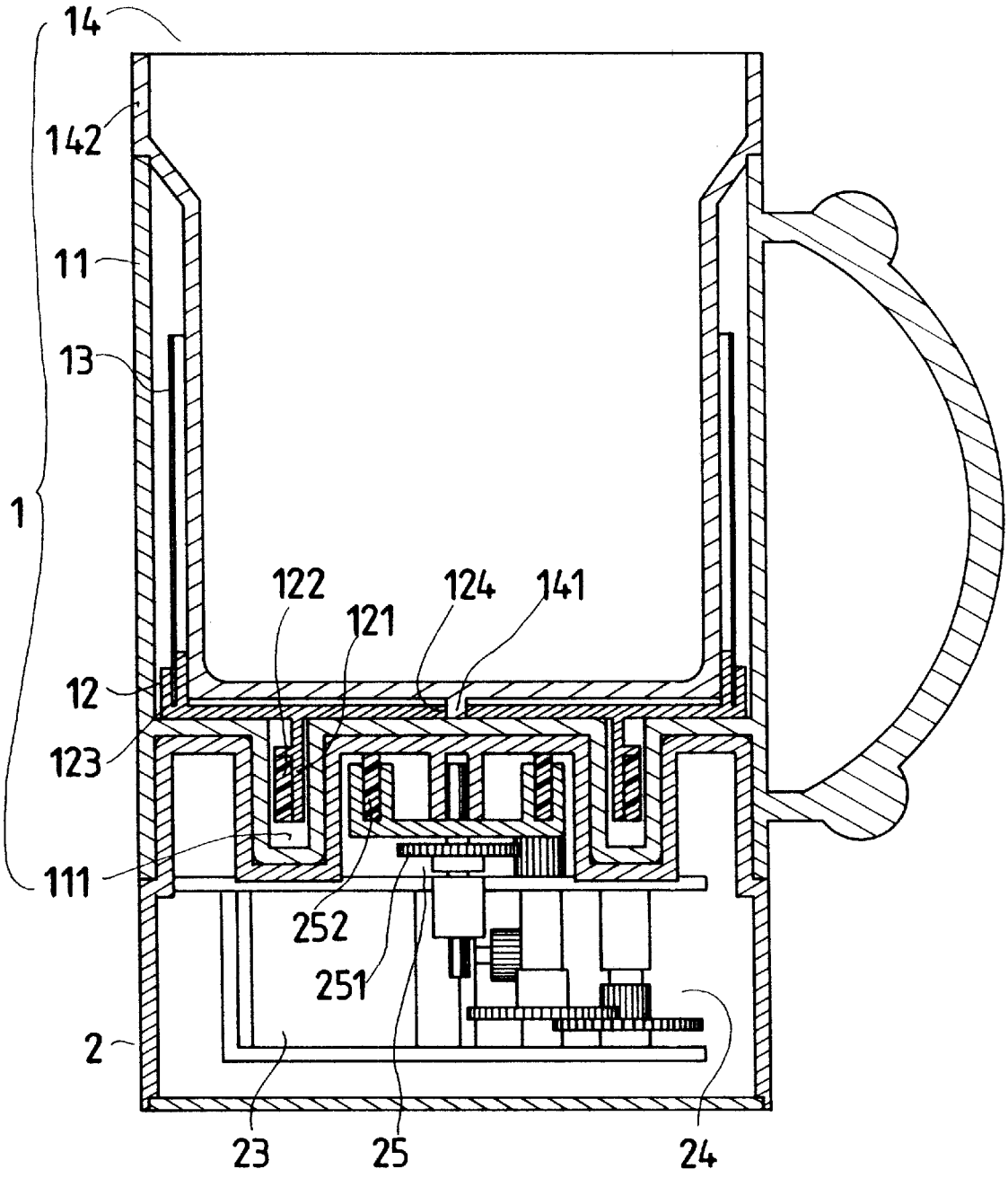
FIG. 2 is cross-sectional view of the first embodiment of the cup of the present invention.
Figure 3:
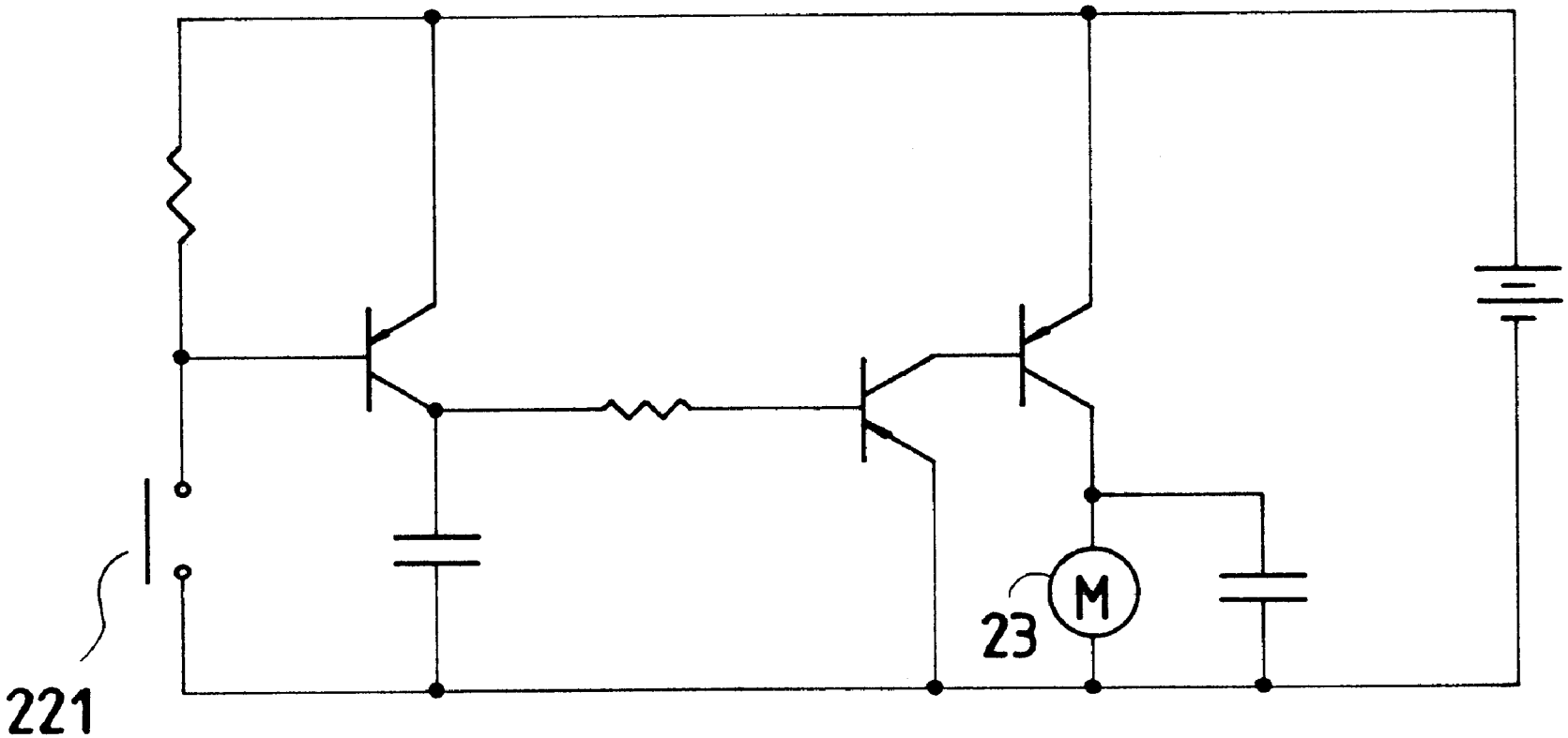
FIG. 3 is a preferred drive circuit for the cup of the present invention.

A first preferred embodiment of a cup in the present invention, as own in FIG. 1, 2 and 3, includes a cup body 1 and a base 2 as main components.

The cup body 1 consists of an outer cup 11, a revolving member 12, a decorative ring 13, and an inner cup 14. The outer cup 11 contains the revolving member 12, the decorative ring 13 and the inner cup 14, having an annular groove 111 formed in a bottom for projecting-down members 121 of the revolving member 12 to fit and move along therein. The projecting-down members 121 respectively have plural magnets 122, and the revolving member 12 has plural U-shaped insert means 123 for the decorative ring 13 to fit therein.

The inner cup 14 has a shaft extending down from the center of the bottom to insert in a center hole 124 of the revolving member 12, and a large flange 142 on top to fit around an upper annular edge of the outer cup 11 and adhered firmly together. The outer cup 11 and the decorative ring 13 are transparent, and the decorative ring and the inner cup 14 are printed with patters. The outer cup 11 further has a connect section 112 provided with an inverted L-shaped aperture 113.

The base 2 includes a housing 21, a drive circuit 22, a motor 23, a gear unit 23, a rotating member 25 and a bottom cap 26. The housing 21 has a smaller diameter connect portion 211 formed in an upper portion for the connect section 112 of the outer cup 11 to fit around, and the connect portion 211 has an engage projection 212 to engage the aperture 113 and rotate therein for an angle to combine the cup body 1 with the base 2.

The housing 21 contains the drive circuit 22, the motor 23, the gear unit 24 and the rotating member 25, having its bottom covered by a bottom cap 26.

The bottom cap 26 has a battery 261 supplying electric power to the drive circuit 22 to drive the motor 23, which then rotates the gear unit 24 fixed on its shaft. Then the gear unit 24 engages a gear 251 of a shaft of the rotating member 25 to rotate the rotating member 25, which has many magnets 252 at an outer edge. Then the magnets 252 moves near the annular groove 111 to attract the magnets 122 of the revolving member 12. In addition, the drive circuit 22 has a vibration switch 221 connected in series with a power input terminal, so the drive circuit will be turned on when the vibration switch 221 gets vibration.

In using, the cup body 1 is placed on the base 2, and is vibrated to let the vibrate switch also vibrate to turn on the drive circuit 22, which then powers the motor 23 to rotate the gear unit 24, which then rotates the rotating member 25, letting the revolving member 12 revolve by means of mutual attractions of the magnets 122, 252, with the decorative ring 13 also revolving together. Therefore, the patterns of the decorative ring 13 and of the inner cup 14 mutually cross over to produce interesting views to onlookers.

Figure 4:
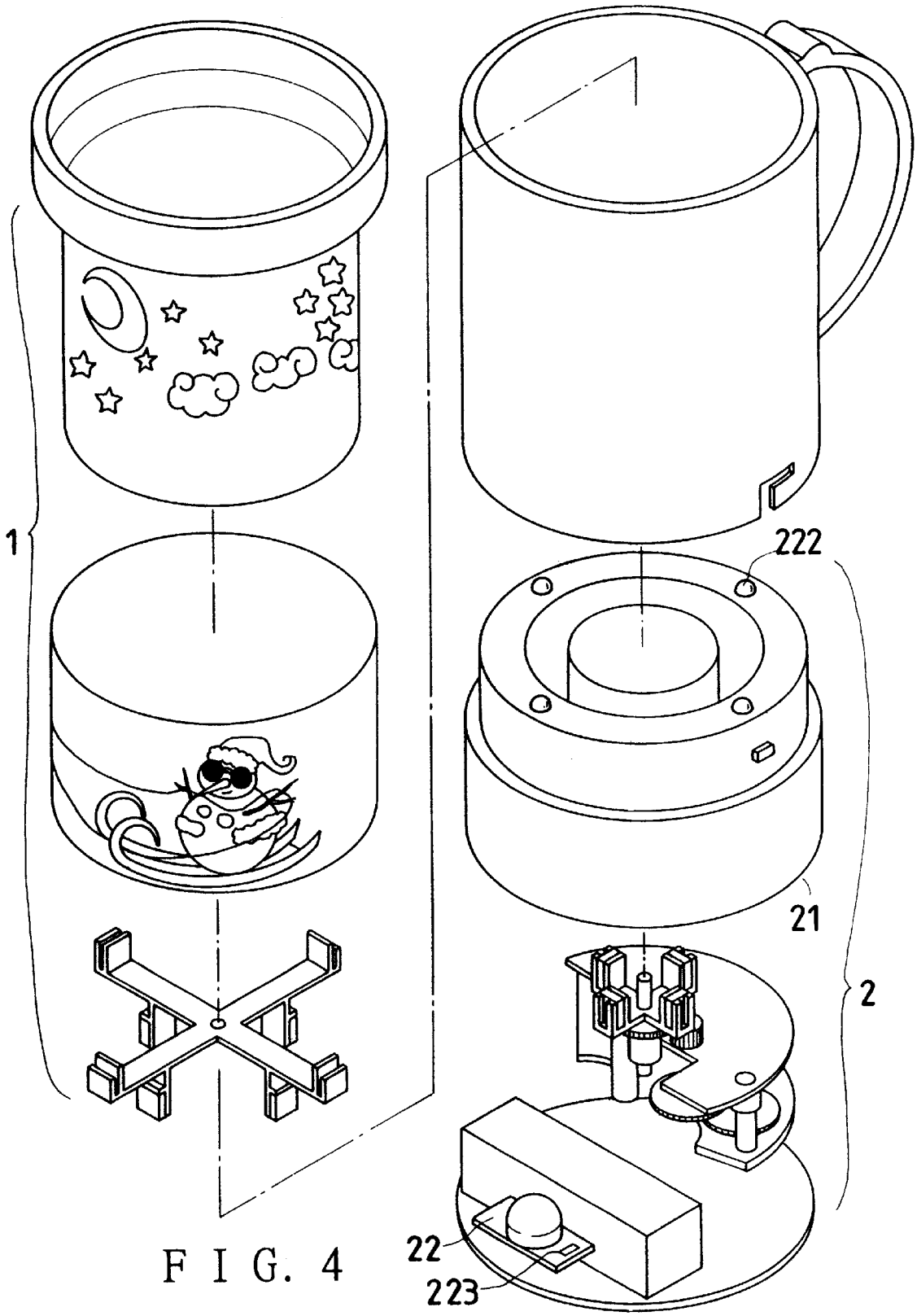
FIG. 4 is an exploded perspective view of a second embodiment of a cup of the present invention.

Next, FIG. 4 shows a second embodiment of a cup, which has a housing 21 for the base 2, and a plurality of light producers 222 (such as LED, light emitting diodes) are fixed on an upper surface of the housing 21 and connected to the output terminal of the drive circuit 22 connected to a musical IC 223 so that the IC 223 may sound out music whenever the vibration switch 221 is vibrated to light up the light producers 222.

Figure 5:
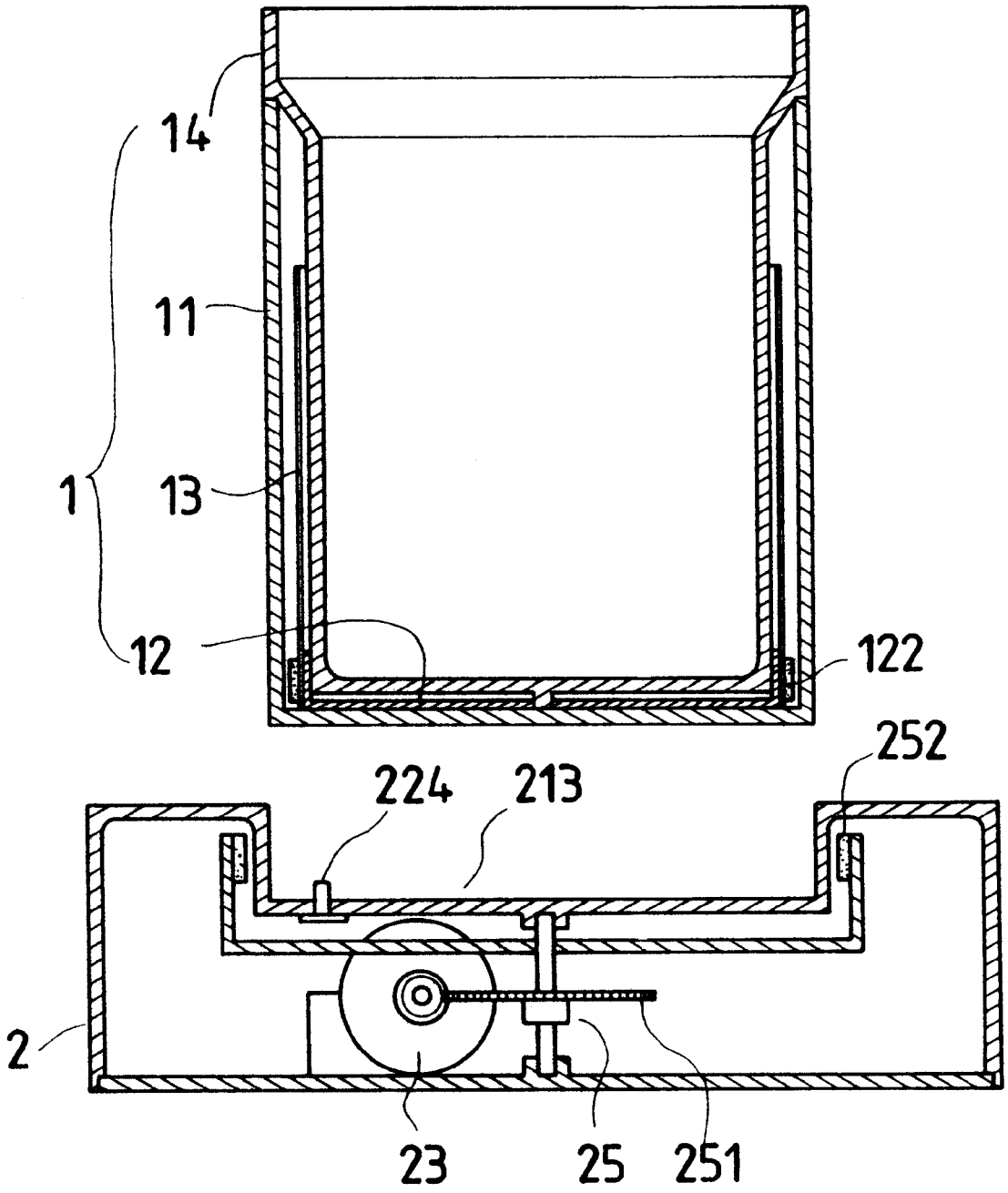
FIG. 5 is a cross-sectional view of a third embodiment of a cup of the present invention.
Figure 6:
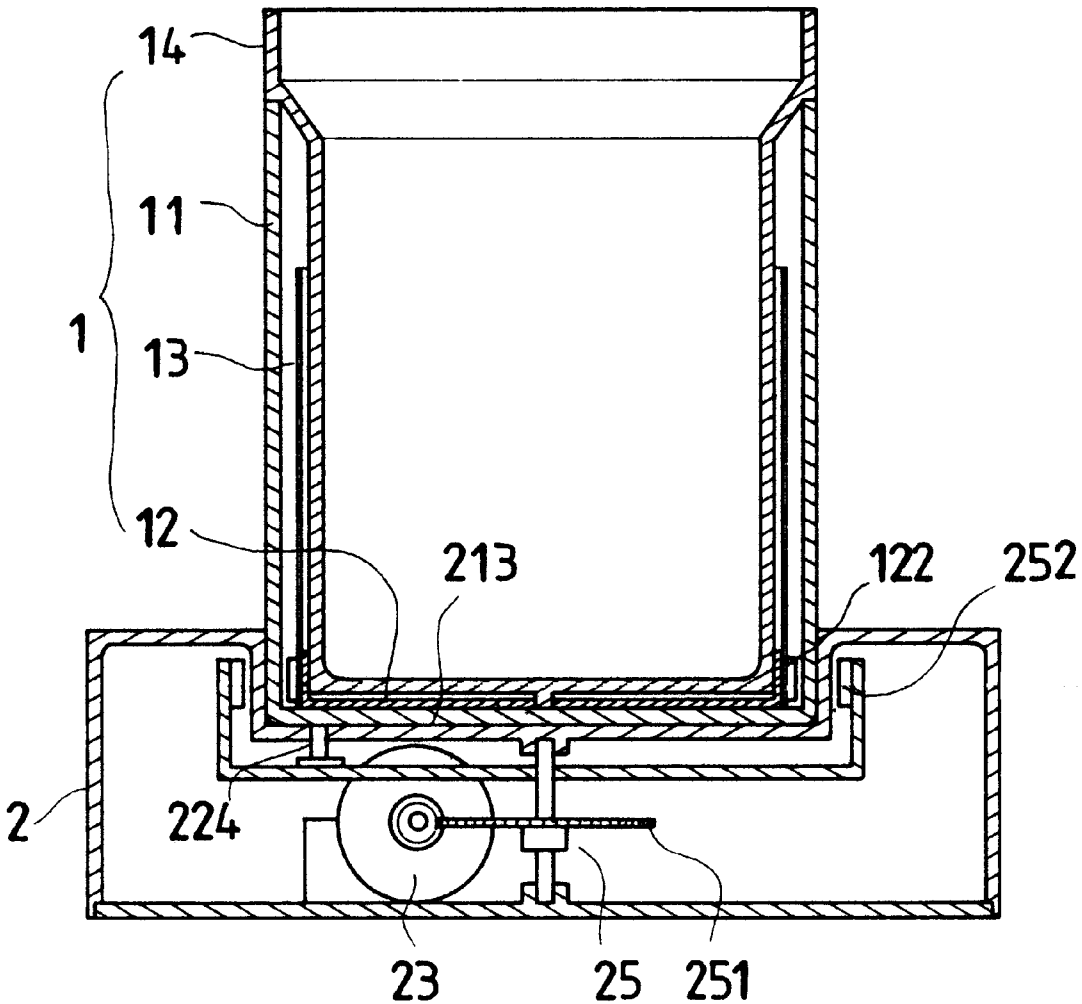
FIG. 6 is a cross-sectional view of the third embodiment of the cup of the present invention, showing a cup body is placed on the base.

Further, FIGS. 5 and 6 show a third embodiment of a cup, which has the magnets 122 fixed on an outer edge, and the housing 21 has a center recess 213 for the bottom of the cup. body 1 to sit stabilized thereon. The magnets 252 of the rotating member 25 are positioned near the wall defining the center recess 213, and the gear 251 of the rotating member 25 directly engages the shaft of the motor 23 or engages the gear unit 24 in FIG. 2 engaging the shaft of the motor 23. In addition, a press means of a press switch 224 is fixed to protrude up the bottom of the center recess 213, and the press switch 224 is electrically connected to the drive circuit 22. Then when the cup body 1 is placed on the center recess 213 of the base 2, the cup body may press the press switch 224 to turn on the drive circuit 22 to power the motor 23 rotate the rotating member 25, and subsequently the revolving member 12 also revolves by mutual attraction of the magnets 122, 252. Then the decorative ring 13 also rotates to cross over the pattern of the inner cup body to produce intriguing effect.

The invention has the following advantages, as can be understood from the aforesaid description.

1. The patterns of the decorative ring and of the inner cup body produce mutual cross over to cause intriguing effect, when the cup body is placed on the base, automatically turning on the drive circuit to drive the motor and the rotating member, which provokes mutual attraction of the magnets to make the revolving member and the decorative ring rotate.
2. The cup body can be easily taken off the base so as to wash. so the circuit contained in the base cannot be wetted by water in washing the cup body.
3. It can save electricity by the cup body pressing the press switch or vibrated to move the vibrate switch to cause the decorative ring rotate.
4. The music IC connected to the drive circuit produces music whenever the motor is powered.
5. The light producers on the housing of the base give out light whenever the motor is powered.

What is claimed is:

1. A cup comprising:

a cup body consisting of an outer cup, a revolving member, a decorative ring and an inner cup, said revolving member having plural magnets, said decorative ring fixed around an outer edge of said revolving member, said inner cup fitted in said decorative ring, said outer cup and said inner cup adhered firmly together at their topsides, said outer cup and said decorative ring being transparent, said decorative ring and said inner cup printed with patterns:

a base having a housing, a drive electric circuit, a motor and a rotating member contained in said housing, and a bottom cap closing up the bottom of said housing, said housing having an upper surface for said cup body to stand on, said drive circuit automatically turned on when said cup body is placed on said housing, said motor powered by said drive circuit to rotate a gear unit fixed on a shaft of said rotating member so as to let said rotating member rotate, said rotating member having plural magnets to attract magnets provided on said revolving member; in using said cup, said cup body placed on the upper surface of said base to turn on said drive circuit and subsequently said motor and said rotating member rotated so that said revolving member and said decorative ring may be revolved by means of mutual attraction of said magnets of said rotating member and of said revolving member, causing said patterns of said decorative ring and said inner cup to cross over mutually to produce intriguing effect.

2. The cup as claimed in claim 1, wherein said outer cup body has an annular groove formed in its bottom for plural projecting-down means of said revolving member to fit and move therein, said plural projecting-down means respectively having plural magnets; said magnets of said rotating member of said base located near said annular groove so as to attract said magnets of said revolving member.

3. The cup as claimed in claim 1, wherein said inner cup has a comparatively large flange on top to rest on an upper end of said outer cup and firmly adhered together.

4. The cup as claimed in claim 1, wherein said outer cup has a lower connect section provided with an inverted L-shaped aperture, and said housing of said base has a smaller diameter connect portion formed on an upper portion for said connect section of said upper cup body to fit around, said connect portion of said housing having a projection to fit and rotate in said aperture of said upper cup body so as to combine firmly said cup body with said base.

5. The cup as claimed in claim 1, wherein said bottom cap of said base has a battery room for containing a battery to supply electric power to said drive circuit.

6. The cup as claimed as claim 1, wherein a gear unit is provided between said motor and rotating member to transmit rotation.

7. The cup as claimed in claim 1, wherein a vibration switch is connected in series to a power input terminal of said drive circuit, so said drive circuit can be turned on only when said vibration switch is vibrated.

8. The cup as claimed in claim 1, wherein an music IC is connected to said drive circuit, producing music when said drive circuit is turned on to drive said motor.

9. The cup as claimed in claim 1, wherein plural light producers are fixed on an upper surface of said housing of said base, connected to an output terminal of said drive circuit to give out light when said motor is powered.

10. The cup as claimed in claim 1, wherein said magnets of said revolving member are fixed on an outer side, and said housing of said base has a center recess formed in an upper surface for said cup body to rest thereon, said magnets of said rotating member extending near said center recess so as to attract said magnets of said revolving member.

11. The cup as claimed in claim 10, wherein a press means of a press switch is provided to protrude up in said center recess of said housing of said base, said press switch connected to said drive circuit, said press means of said press switch pressed to turn on said press switch and subsequently said drive circuit when said cup body is placed on said center recess of said housing of said base.

* * * * *